US006451194B2

(12) United States Patent
Maresch et al.

(10) Patent No.: US 6,451,194 B2
(45) Date of Patent: Sep. 17, 2002

(54) PROCESS FOR PREPARING AND REPLENISHING AN ELECTROLYTE IN AN ELECTROLYTE BATH

(75) Inventors: Gerald Maresch, Mödling (AT); Herbert Track, Mauerbach (AT); Lutz Wieser, Vienna (AT)

(73) Assignee: Andritz-Patentverwaltungs-Gesellschaft m.b.H., Graz (AT)

( * ) Notice: Subject to any disclaimer, the term of this patent is extended or adjusted under 35 U.S.C. 154(b) by 31 days.

(21) Appl. No.: 09/818,643

(22) Filed: Mar. 28, 2001

Related U.S. Application Data

(62) Division of application No. 09/335,895, filed on Jun. 18, 1999, now Pat. No. 6,231,729.

(30) Foreign Application Priority Data

Jun. 19, 1998 (AT) ..... 1057/98

(51) Int. Cl.[7] ..... C25D 21/12; C25D 5/00

(52) U.S. Cl. ..... 205/81; 205/101; 205/305; 205/271; 222/145.5

(58) Field of Search ..... 205/81, 98, 101, 205/305, 271, 338; 204/DIG. 13; 366/17, 18, 244; 222/145.5, 145.6

(56) References Cited

U.S. PATENT DOCUMENTS

| | | | | |
|---|---|---|---|---|
| 3,194,540 A | | 7/1965 | Hager | |
| 4,599,363 A | | 7/1986 | Miles, Jr. et al. | |
| 5,540,499 A | | 7/1996 | Seeger | |
| 5,573,652 A | | 11/1996 | Kiyama et al. | |
| 5,609,747 A | * | 3/1997 | Sakurai et al. | 205/244 |
| 5,882,502 A | * | 3/1999 | Gomez | 204/222 |

* cited by examiner

*Primary Examiner*—Nam Nguyen
*Assistant Examiner*—Wesley A. Nicolas
(74) *Attorney, Agent, or Firm*—Roylance, Abrams, Berdo & Goodman, L.L.P.

(57) ABSTRACT

A process and apparatus for supplying a soluble metal compound to an electrolyte solution uses a powder wetting device in a loop from a working tank. The powder wetting machine supplies the powdered metal compound directly into the electrolyte solution which rapidly dissolves to replenish the electrolyte compound during the treating process. The process and apparatus are particularly suitable for replenishing the metal salts consumed during an electroplating process.

14 Claims, 3 Drawing Sheets

PROCESS FOR PREPARING AND REPLENISHING AN ELECTROLYTE IN AN ELECTROLYTE BATH

This application is a divisional application of Ser. No. 09/335,895, filed Jun. 18, 1999, now U.S. Pat. No. 6,231, 729.

FIELD OF THE INVENTION

The present invention is directed to a process and apparatus for preparing an electrolyte bath and for replenishing an electrolyte in an electrochemical bath. More particularly, the invention is directed to a process for feeding a metal salt into an electrolyte solution that has been depleted of an electrolyte during an electrochemical process to replenish the solution with the electrolyte.

BACKGROUND OF THE INVENTION

In recent years, there has been an increase in demand for corrosion resistant steel and processes of treating steel to impart corrosion resistance. High speed electroplating methods typically use high current densities. This type of electroplating method requires a rapid system for supplying the consumed electrolyte. Generally, this method uses an insoluble electrode and feeds the electrolyte into the bath in a soluble form.

An acid, such as sulfuric acid, is often used in electroplating zinc baths. The zinc is usually supplied as zinc oxide that is dissolved or dispersed in water and then dissolved in the sulfuric acid. Metallic zinc can be added to the acid bath which will dissolve in the sulfuric acid. Zinc in metal form is generally less preferred since the metallic zinc dissolves slowly in sulfuric acid and is not suitable for high production plating devices.

Conventional electroplating plants usually include a mixing tank, separate from the treating bath, for dissolving the metal source in the plating bath. The mixing tanks typically include an agitator and a steam connection for dissolving the metal source. The metal source is usually added in the form of a metal salt. The metal salts are dissolved in hot water and then transferred to the tank for the treating bath. Some metal compounds, such as zinc oxide, cannot be added directly to the acid bath and must first be dissolved in hot water.

The metal salts and metal compounds are often toxic and product large quantities of dust when added to the mixing tank. The metal salts are usually supplied in containers such as barrels or bags which expose the workers to large amounts of toxic dust, thereby increasing the health risks to the workers.

Modern electroplating plants using insoluble anodes require continuous resupplying of the metals being deposited on the substrate. The metals must be supplied to the plating bath either by dissolving the metal directly or by the addition of galvanic salts. In a similar manner, conducting salts also must be added continuously to the electrolyte bath to increase the conductivity of the electrolyte bath and reduce the electrical power consumption. The conducting salts are continuously depleted during the plating process with the primary plating metal and must be replenished.

High output plants typically use a silo and an automatic weighing device to supply the salts to the bath. The plants also include a dosing device to feed the salts to the dissolving tank. The tanks require expensive dust recovery devices to prevent the escape of dust particles to the atmosphere. The handling of the toxic dust particles complicates the operations and operating costs.

The prior large scale plants and the feeding and mixing arrangements form lumps in electrolyte bath when the salts are added. The agitating devices in the mixing tanks are not always able to prevent the formation of lumps in the bath.

Accordingly, there is a continuing need in the industry for improved systems for electrochemical treatment plants.

SUMMARY OF THE INVENTION

The present invention is directed to a process and apparatus for preparing an electrolyte solution and replenishing an electrolyte in an electrochemical treatment bath. More particularly, the invention is directed to a process and apparatus for supplying a metal salt to an electroplating bath.

Accordingly, a primary object of the invention is to provide a method and apparatus for feeding a metal salt to an electrolyte bath to replace the metal ion and other salts consumed in an electroplating process.

A further object of the invention is to provide a process and apparatus for adding electrolyte salts and/or chemicals to the electrolyte bath by the vacuum generated in a powder wetting machine.

Another object of the invention is to provide a process and apparatus for adding electrolyte salts and/or chemicals to an electrolyte bath from one or more tanks, silos or containers via one or more weighing devices to calculate the precise amount of galvanic salts and/or chemicals required to be added, where the calculated amount corresponds to the amount of electrolyte consumed in an electrochemical treatment process.

A further object of the invention is to provide a process and apparatus for adding the galvanic salts and/or chemicals continuously to an electrolyte bath. The galvanic salts and/or chemicals can also be added periodically in cycles according to the rate of consumption of the metal ions from the electrolyte solution.

Another object of the invention is to provide a process and apparatus having a reaction tank downstream of a powder wetting machine to provide a reaction time between 1 and 60 minutes, preferably between 1 and 10 minutes, prior to supplying to a reaction tank to replenish an electrolyte bath with a galvanic salt.

A further object of the invention is to provide a pump for directing an electrolytic liquid to a powder wetting machine.

Still another object of the invention is to provide a process and apparatus using a pump for directing an electrolytic liquid back to an electrolytic tank from a reaction tank.

Another object of the invention is to provide a process and apparatus for determining electrolyte consumption from an electrolyte bath by obtaining pH measurements, turbidity measurements, photometric or conductivity measurements or of an analysis of the dissolved ions by means of X-ray fluorescence of an electrolyte bath, and regulating the input feed of galvanic salts and/or chemicals to a powder wetting machine for replenishing the bath with an electrolyte.

A further object of the invention is to provide a method and apparatus for replenishing the consumed galvanic salts and/or chemicals in proportion to the surface area of a substrate being treated with an electrolyte bath. The galvanic salts and/or chemicals consumed can also be replenished in proportion to the depositing electric current in an electroplating plant.

The objects of the invention are basically obtained by providing a process of supplying a soluble metal compound to an electrolyte solution comprising providing an electrolyte solution and directing the electrolyte solution through a powder wetting device and producing a vacuum in the powder wetting device, and supplying a soluble metal compound to the vacuum to draw the soluble metal compound into the device and dispersing the soluble metal compound in the electrolyte solution passing through the powder wetting device.

The objects of the invention are further attained by providing a process for electrochemically treating a metal substrate comprising the steps of: supplying an electrolyte solution to an electrolytic tank, contacting a metal substrate with the electrolyte solution in the electrolytic tank, applying an electric current through the electrolyte solution to treat the metal substrate, continuously directing the electrolyte solution from the electrolytic tank to a powder wetting device and producing a vacuum zone in the powder wetting device, supplying a soluble metal compound to the vacuum zone in the powder wetting device and drawing the metal compound into the powder wetting device and dispersing the compound in the electrolyte solution, and returning the electrolyte solution to the electrolytic tank.

The objects of the invention are further attained by providing an apparatus for treating a metal substrate with an electrolyte solution. The apparatus comprises a treating tank for containing an electrolyte solution and for treating the metal substrate, a powder wetting device connected to the treating tank for receiving the electrolyte solution and forming a vacuum zone in the powder wetting device, a conduit for directing the electrolyte solution from the powder wetting machine to the treating tank, and a supply for supplying a soluble metal compound to the vacuum zone in the powder wetting machine for dispersing the metal compound in the electrolyte solution.

The objects, advantages and other salient features of the invention will become apparent to one skilled in the art as described in the following detailed description of the invention and the annexed drawings.

BRIEF DESCRIPTION OF THE DRAWINGS

The following is a brief description of the drawings which form a part of this original disclosure in which.

DETAILED DESCRIPTION OF THE INVENTION

Figure 1:
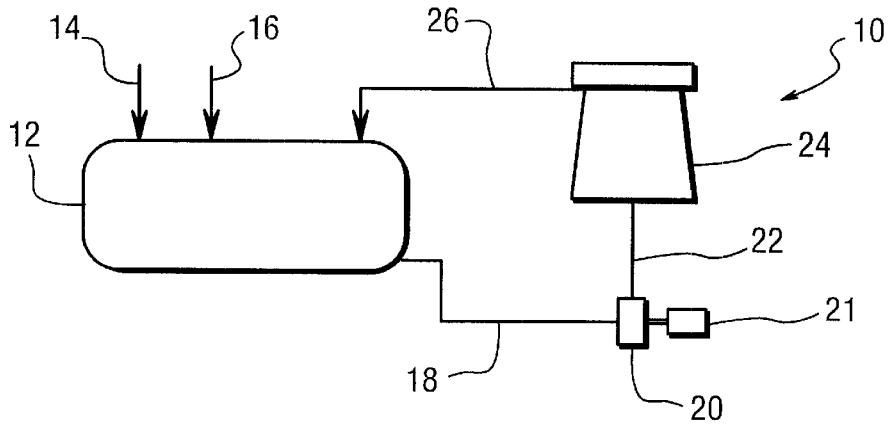
FIG. 1 is a schematic diagram of a plant having a mixing tank for supplying a zinc electrolyte to an electrolyte bath.

The present invention is directed to a process and apparatus for supplying a soluble metal compound or galvanic salt to an electrolyte solution. More particularly, the invention is directed to a process and apparatus for producing an electrolyte solution and replenishing the electrolyte in the solution for use in an electrochemical processing tank. As used herein, the term electrochemical process refers to processes using an electrolyte solution to treat a material, typically a metal substrate. In the preferred embodiments disclosed herein, the electrochemical process is an electroplating process for coating steel with zinc or zinc alloys as known in the art.

The process and apparatus of the invention are suitable for feeding a powdered material and particularly a powdered electrolyte compound, such as a salt, directly into an electrolyte bath. The powdered electrolyte is drawn by a suction or vacuum created by a powder wetting device which directs the powdered electrolyte directly into a moving stream of the electrolyte solution so that the powder is uniformly dispersed in the moving solution. The particle size of the powdered material is sufficiently small to be drawn by the vacuum created by the powder wetting device into the solution and to be easily dispersed and dissolved in the solution without settling to the bottom of the tank. Generally, the particle size of the powdered material is about 100 microns or less, and preferably about 50 microns or less.

The process and apparatus are primarily directed to supplying an electrolyte to an electroplating bath. In further embodiments, the process and apparatus can be used for feeding other solid particulate materials into a solution where the particulate material is soluble. The solution can be, for example, a pickling solution for treating steel or stainless steel. In preferred embodiments, the particulate material is a soluble metal compound capable of dissociating in solution. Examples of suitable metal compounds include oxides, hydroxides, carbonates, and other salts.

The process and apparatus of the invention are primarily used for producing an electrolyte solution for electroplating a metal substrate in an electroplating apparatus. In preferred embodiments of the invention, the electrolyte solution contains zinc ibns ($Zn^{2+}$) in a suitable form for electroplating a steel substrate as known in the art. In further embodiments, the electrolyte solution contains a combination of zinc ions and nickel ions to form a zinc/nickel coating on a steel substrate.

The process and apparatus of the invention are suitable for supplying most galvanic salts and electrolytes in a solid particulate form directly into an electrolyte solution. The electrolyte solution can be an acidic or alkaline solution with a pH of about 0–14. Acid electrolyte solutions generally have a pH of about 1.0–2.0. Alkaline electrolyte solutions have a pH of at least 9.5, and generally a pH higher than 9.5.

The electroplating apparatus for producing a galvanized zinc coating on a steel substrate is a standard apparatus as known in the art. One example of a suitable electroplating apparatus is generally disclosed in U.S. Pat. No. 4,367,125 which is hereby incorporated by reference. Galvanizing zinc electrolyte solutions contain a high concentration of sulfuric acid to maintain a pH of about 2.0 to about 2.5 and $Zn^{2+}$ ions. Typically, the galvanizing process uses insoluble electrodes that require a pH of 2.5 or less for effective zinc deposition. The metal substrate, which is typically a continuous strip of steel, is passed through the electrolyte bath and a direct electrical current is applied to the bath to coat the zinc on the steel strip. The steel strip is coupled to a DC power source to enable the steel strip to act as a cathode. The zinc ions are reduced at the cathode to form the zinc coating on the steel. The anode in the electrolyte solution produces hydrogen ions from the water to decrease the pH of the sulfuric acid plating solution.

As the electroplating process continues, the zinc ions in the electrolyte solution are depleted along with other electrolytes which must be replaced to enable the process to continue efficiently. Zinc oxide is typically added to the sulfuric acid plating solution as a source of $Zn^{2+}$. The zinc oxide reacts with the hydrogen ions in the sulfuric acid plating solution to produce zinc ions. This reaction consumes the hydrogen ions in the plating solution so that the pH increases. The sulfuric acid plating solution, which is replenished with the zinc ions, is then returned to the plating bath for plating the steel sheet. Preferably, the pH is less than about 2.5.

Referring to FIG. 1, a conventional electrolytic strip galvanizing apparatus 10 is schematically illustrated. The apparatus 10 includes a working tank 12 for containing the electrolyte solution. The working tank 12 includes a feeding device for feeding a strip of steel into the electrolyte solution and an anode immersed in the electrolyte solution. The continuous strip of steel is coupled to a power source to function as a cathode in the plating process. The feed mechanism and coupling for the power source are conventional electroplating devices as known by those skilled in the art of zinc electroplating and are not shown for simplicity. Alternatively, the electrolyte solution in the working tank 12 can be transferred to a separate electroplating tank.

The electrolyte solution in the working tank of the embodiment of FIG. 1 is prepared by initially supplying demineralized water to the working tank 12. The working tank 12 has a volume of about 50 cubic meters and is filled with about 40 cubic meters of demineralized water from a pipe 14. Concentrated sulfuric acid is supplied through a pipe 16 and is continuously metered into the tank 12. The acid solution is circulated through a line 18 by a pump 20, which is operated by a motor 21, and circulated through a line 22 to a dissolving column 24. The dissolving column 24 generally contains metallic zinc granules in a bed for contacting the acid. The acid solution passes through the bed of zinc granules and dissolves the zinc. The acid solution and dissolved zinc is returned to the working tank 12 by a line 26.

The zinc dissolves very slowly in the acid solution so that the circulation through the system and the column is carried out for many hours before the acid solution contains a sufficient quantity of zinc ions ($Zn^{2+}$). A zinc concentration of about 115 grams $Zn^{2+}$ per liter can take up to 70 hours to attain. The amount of acid circulated through the column 24 is metered to control the production of hydrogen in the column which must be discharged to the atmosphere. The exhaust gas from the column 24 must maintain a hydrogen concentration of no more than 40% UEG, which is the lower explosion limit for hydrogen gas mixtures. The lower explosion limit for hydrogen gas in air is about 4% by volume.

Once the zinc concentration reaches the desired level, the electrolytic galvanizing process is initiated to plate or coat the steel substrate. The pump 20 continuously circulates the electrolyte solution through the column 24 to continuously dissolve the zinc and replenish the zinc in the electrolyte solution. The flow rate of the electrolyte solution through the column 24 is controlled in proportion to the amount of zinc deposited on the steel strip.

Figure 2:
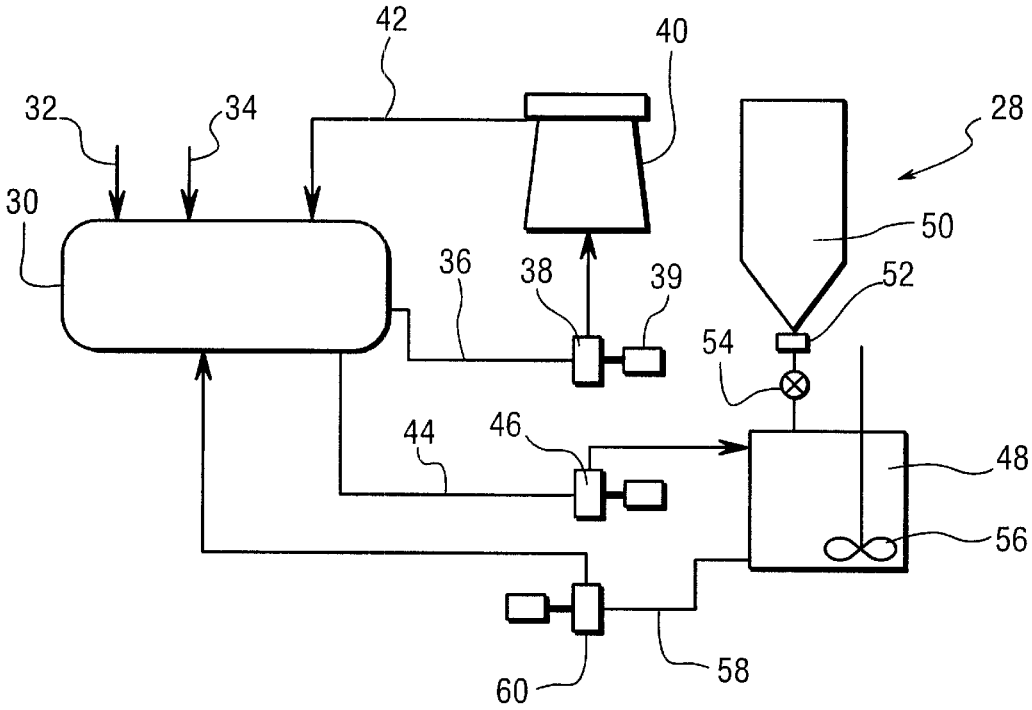
FIG. 2 is a schematic diagram of a plant for electroplating a zinc-nickel coating on a continuous strip of material and having a mixing tank for resupplying the electrolytes to the bath.

FIG. 2 illustrates a schematic diagram of an apparatus for forming a zinc/nickel electrolyte solution for electroplating a steel substrate. The apparatus 28 includes a working tank 30 which has a volume of about 50 cubic meters. The tank 30 is filled with demineralized water through a pipe 32 which is heated to about 55° C. Concentrated sulfuric acid is added to the tank 30 through the pipe 34 and is metered continuously into the tank. The acid solution in the tank 30 has a pH of about 2.0. The acid solution is carried through a pipe 36 by a pump 38 driven by motor 39 to a column 40. The column 40 contains zinc granules which are dissolved by the acid passing through the bed of granules. The acid is then returned to the tank 30 by a pipe 42. The acid is circulated through the system and the column 40 to dissolve the zinc at a rate to maintain the hydrogen concentration in the exhaust gas from the column at less than about 4% by volume. The acid is circulated through the column for sufficient time to obtain a zinc concentration of about 55 grams $Zn^{2+}$ per liter in the acid solution. Generally, this takes about 40 hours to obtain this zinc concentration.

After the zinc concentration of the acid solution reaches the target value, the pump 38 is stopped and the acid solution is carried through a pipe 44 by a pump 46 to a mixing tank 48. The mixing tank 48 has a volume of about 10 cubic meters. When the tank 48 is filled with the acid solution, a powdered nickel carbonate is fed into the mixing tank 48 from a silo 50. The nickel carbonate is fed from the silo 50 to a weighing device 52 and metered into the mixing tank 48 by a metering device 54. The nickel carbonate is added to the mixing tank 48 in an amount to maintain the pH of the acid solution at about 2.5 or less. An agitator 56 is positioned in the mixing tank 48 to disperse the nickel carbonate and dissolve the nickel carbonate in the acid solution. When the nickel carbonate is dissolved, the resulting solution is returned to the tank 30 through a line 58 by a pump 60. The process is repeated until the acid electrolyte solution has a nickel concentration of about 80 grams. This generally takes an additional 40 hours to achieve the desired nickel concentration.

The resulting solution in the working tank 30 is used in the electroplating process. During the electroplating process, the electrolyte solution is circulated through the column 40 to replenish the zinc that is deposited on the steel strip. The electrolyte solution is carried through the column 40 at a rate in proportion to the rate of deposition of the zinc on the steel strip. The nickel is replenished intermittently by carrying a portion of the electrolyte solution to the tank 48. An amount of nickel carbonate is added to the mixing tank 48 corresponding to the nickel that is depleted from the electrolyte solution during the plating process. The solution from the tank 48 is then carried back to the working tank 30 to replenish the nickel in the electroplating solution.

Figure 3:
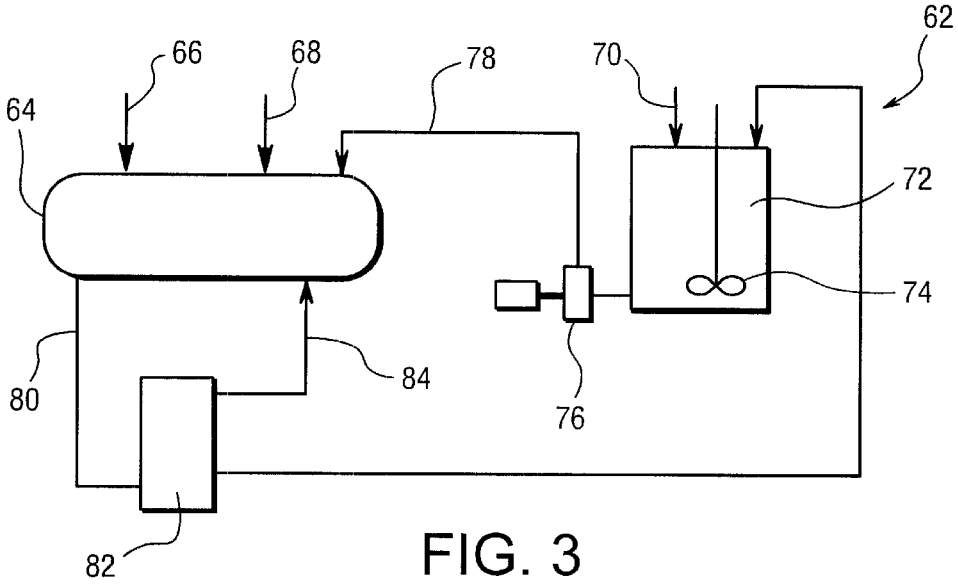
FIG. 3 is a schematic diagram of a zinc electroplating plant having a mixing tank for supplying zinc electrolyte to the bath.

FIG. 3 illustrates another apparatus for preparing and replenishing zinc in a solution for electroplating a steel substrate. The apparatus 62 includes a working tank 64 having a volume of about 50 cubic meters which is filled with demineralized water from a pipe 66. A concentrated sulfuric acid is added through a pipe 68. Water is also added through a pipe 70 to a mixing tank 72 containing zinc oxide. The water is heated to about 60° C. and mixed by an agitator 74 to provide a 10% to about 20% zinc oxyhydrate suspension. This suspension is then added to the tank 64 by a pump 76 through a line 78. The resulting solution in the tank 64 is used in the electroplating process.

A zinc oxide suspension is continuously added in proportion to the amount of zinc depleted from the electrolyte solution. Since the zinc oxide suspension contains added water, the resulting electrolyte solution is diluted with each addition of the zinc oxide suspension. To maintain the desired zinc concentration in the electrolyte solution, water is removed from the solution by carrying the electrolyte solution through a pipe 80 to a condensing unit 82 where water is removed. The concentrated electrolyte solution is returned to the tank 64 through a pipe 84 and the water is carried back to the tank 72 for preparing the zinc oxide suspension.

In embodiments where the electrolyte solution is used as a pickling solution for stainless steel, an aqueous solution of sodium sulfite is generally added to the electrolyte solution as a conducting salt for no-contact current transfer. The solution is generally prepared in an impeller type mixer with a shaker or feed screw for supplying the sodium sulfate to the water. The added water for preparing the sodium sulfate also dilutes the acid solution which must be removed to retain the desired concentration. In addition, steam from the hot solution causes the salt to form lumps and clog the screw feeder.

Figure 4:
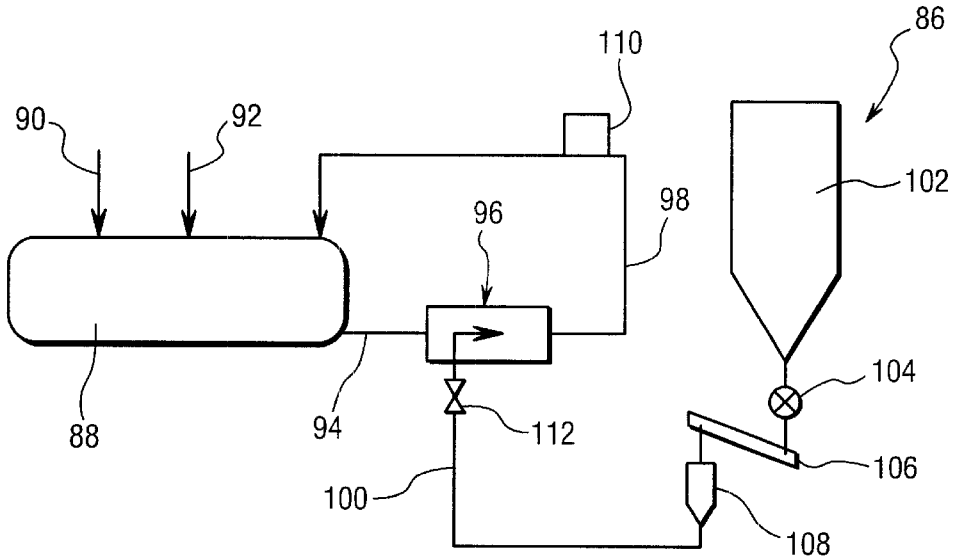
FIG. 4 is a schematic diagram of a zinc electroplating plant in a first embodiment of the invention.

Referring to FIG. 4, a first embodiment of the invention is illustrated for preparing an electrolyte solution for an electrolytic galvanizing process. The apparatus 86 includes a working tank 88 having a volume of about 50 cubic meters. Tank 88 can be a conventional electroplating tank or other electrochemical tank. Alternatively, tank 88 can be a holding tank for the electrolyte solution where the electrolyte solution can be transferred to a treating tank. The tank 88 is filled with about 40 cubic meters of demineralized water from a pipe 90. The water is heated to a suitable temperature for dissolving the zinc oxide. Generally, the water is heated to about 55° C. Concentrated sulfuric acid is added to the tank 88 through a pipe 92 to adjust the pH of the solution in the tank 88 to a valve suitable for dissolving the zinc oxide and functioning in the electroplating process. The pH is generally less than about 2.5, and preferably about pH 1.0–2.0. A line 94 extends from the tank 88 to a powder wetting device 96.

The powder wetting device 96 draws the acid solution from the tank 88 and discharges the acid solution through a line 98 back to the tank 88. The powder wetting device 96 includes an inlet pipe 100 for supplying powdered zinc oxide which then is dispersed in the circulating acid solution. A supply container, such as a silo 102, contains powdered zinc oxide which is fed through a metering device 104 and conveyor 106 to a weighing device 108. The weighing device 108 measures a predetermined amount of the zinc oxide and supplies the measured amount through the pipe 100 to the powder wetting device 96. The weighing device 108 weighs a calculated amount of zinc oxide necessary to obtain a desired zinc concentration for plating.

The powder wetting device 96 operates as a pump by withdrawing the acid solution from the tank 88 through the line 94 and to circulate the acid solution back into the tank 88. The powder wetting device 96 includes an impeller or rotor which rotates at a high speed. The rotational speed of the rotor creates a lower pressure zone in the central area of the rotor which is generally adjacent the inlet for the pipe 100. The lower pressure zone created by the rotor draws the powder through the pipe 100 and directs the powdered material into the acid solution circulating through the device. The powdered material is intimately mixed and dispersed in the acid solution so that the powder dissolves quickly and completely.

The rotor of the powder wetting device 96 rotates at a speed to circulate about 50 to about 70 cubic meters of the acid solution per hour and to generate a vacuum in the line 100 of about 25,000 Pa (0.025 MPa). The rotor speed determines the volume of the electrolyte solution passing through the powder wetting device and the volume of the powdered material fed into the solution.

In embodiments of the invention, the rotational speed of the rotor is adjusted to feed the powdered material into the solution at a rate sufficient to replenish the metal at a rate corresponding to the rate that the electrolyte is depleted from the electrolyte solution in the working tank. In this manner, the electrolyte concentration, and particularly the $Zn^{2+}$ concentration can be maintained at a substantially constant level during the plating process. Preferably, the powdered electrolyte is supplied at a rate to dissolve in the acid solution substantially without settlement in the pipes or tanks. Generally, the rotor speed produces a vacuum of about 15,000 Pa to about 30,000 Pa in the line 100. A suitable powder wetting device for use in the invention is disclosed in U.S. Pat. No. 5,540,499, which is hereby incorporated by reference in its entirety.

Figure 6:
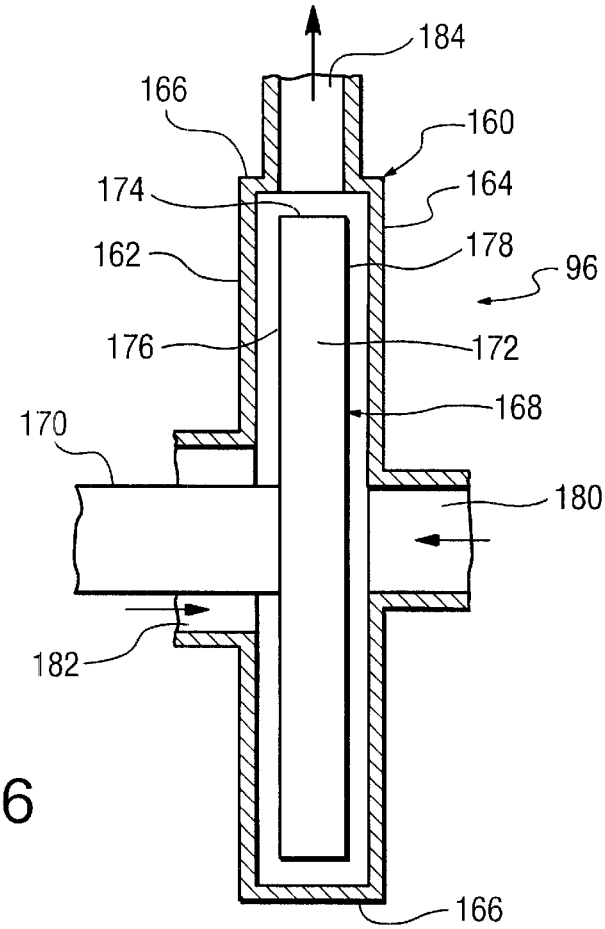
FIG. 6 is a side view in partial cross-section showing the powder wetting device in one embodiment of the invention.

The powder wetting device 96 in one embodiment of the invention is shown in FIG. 6. The powder wetting device 96 includes a housing 160 having a generally disk shape with axial facing side walls 162 and 164 and an outer, radially facing wall 166. A rotor 168 having a drive shaft 170 and an impeller disk 172 is mounted in the housing 160. The impeller disk 172 has an outer edge surface 174 spaced from the outer wall 166 of the housing 160. The impeller disk 172 also has side surfaces 176, 178 spaced from the side walls 162 and 164. The space between the housing and impeller disk define a mixing zone 179. The shaft 170 is coupled to a drive motor (not shown) for rotating the disk about the axis of the shaft 170.

In the embodiment illustrated, the housing 160 includes an axial inlet 180 on the side wall 164 and an axial inlet 182 in the side wall 166. The impeller disc 172 is rotated at a speed to create a suction or vacuum at the axial center of the disk 172 to draw liquid into the housing 160 through the inlet 180. The liquid is carried radially outward along the surfaces of the disk through the mixing zone and discharged through an outlet 184 in the outer wall 166. Simultaneously, a particulate material is fed to the inlet 182 so that the vacuum draws the particulate material into the housing where it is dispersed in the liquid and discharged through the outlet 184. In alternative embodiments, the acid solution can be supplied through inlet 182 and the particulate material supplied through inlet 180.

The impeller disk 172 is shown having substantially flat surfaces. In further embodiments, the surfaces of the impeller disk are provided with fins or vanes to assist in mixing and dispersing the particulate material in the liquid. In further embodiments, the impeller can be of sufficient hardness to crush or grind the particulate material to a suitable size for dispersing in the acid solution.

A secondary treatment tank 110 can be provided in the line 98 downstream of the powder wetting device 96 to allow additional reaction time of the zinc oxide and acid solution before returning to the tank 88. The secondary reaction tank 110 can be incorporated in the system when the operating temperature of the acid solution is below a temperature at which the zinc oxide powder readily dissolves. Preferably, the operating temperature of the acid solution is maintained at about 55° C. so that the zinc oxide powder dissolves and reacts in the acid solution essentially immediately and forms the zinc sulfate solution for the electroplating process.

The powder wetting device 96 generates a sufficient vacuum at the inlet that the zinc oxide powder is drawn into the device without clogging the inlet pipe 100. The zinc oxide is introduced directly into the acid solution near the rotor to provide intimate mixing and rapid dispersion. The particle size of the zinc oxide is generally less than about 100 microns, and preferably less than about 50 microns. Larger particle sizes can be used where the powder wetting device is able to crush or grind the particles to a suitable size.

The zinc oxide is fed through the pipe 100 from the weighing device 108 by the vacuum drawn from the powder wetting device 96. In one embodiment of the invention, the addition of the zinc oxide powder to the acid solution through the powder wetting device is essentially continuous. The supply of the zinc oxide powder is interrupted only during the short period in which the zinc oxide powder is being weighed and measured in the weighing device 108.

In embodiments of the invention, the zinc oxide powder is supplied through the pipe 100 until approximately 80% of the calculated amount of the zinc oxide powder has been added to the acid solution. At that time, an inlet valve 112 is closed to stop the continuous feed. The valve 112 is opened and closed periodically to supply the remaining calculated amount of the zinc oxide powder in a cyclical, step-wise or batch addition. The valve 112 is opened for about 1 to about 10 seconds, and then closed for about 1 to about 60 seconds until all of the calculated amount of zinc oxide has been added to the acid solution. At that time, an additional amount of zinc oxide is weighed for feeding into the powder wetting device 96 to obtain a desired zinc ion concentration.

When the calculated amount of the zinc oxide powder has been added to the acid solution and the zinc concentration has reached the desired level of about 115 grams of zinc ($Zn^{2+}$) per liter, the resulting electrolyte solution is ready for the electroplating process. The steel substrate is fed through the electrolyte solution in the tank 88 and the zinc is plated onto the substrate using standard electroplating procedures. The process of the invention enables the electrolyte solution to be prepared in about 24 hours compared to as much as 40 hours in the prior processes.

During the electroplating process, the zinc concentration in the electrolyte solution is reduced in proportion to the amount of zinc plated on the steel substrate. The powder wetting device 96 is operated to circulate the electrolyte solution and continuously feed additional zinc oxide into the solution to rapidly replenish the electrolyte. The zinc oxide can be added in a stoichiometric amount to maintain the desired zinc concentration. The speed of rotor of the powder wetting device can be selected to feed the zinc oxide at a rate to maintain a desired $Zn^{2+}$ level in the solution. The zinc oxide can be added continuously or in a step-wise fashion.

The amount of zinc consumed during the electroplating process is determined using standard methods as known in the art. For example, measurements of the changes in pH upstream and downstream of the powder wetting device 96, turbidity, and the conductivity of the electrolyte solution can be obtained as an indicator of the amount of zinc consumed during the electroplating process according to standard procedures. The amount of zinc oxide is added to the electrolyte in proportion to the calculated change in pH or conductivity measurements. X-ray fluorescence can also be used to analyze and measure the dissolved ions in the electrolyte solution upstream of the powder wetting device or in the tank 88. These measurements can also be used to calculate the amount of zinc oxide to be added to the electrolyte solution to replenish the zinc.

The process of the invention is advantageous in that the electrolyte solution can be prepared in a shorter amount of time and the zinc can be replenished quickly and efficiently in a controlled fashion. The process also adds the powdered zinc oxide directly to the electrolyte solution to eliminate the preliminary step of dispersing the zinc oxide in water which dilutes the electrolyte concentration and requires the water to be removed by a condensing unit. Zinc oxide also does not produce hydrogen during the solubilizing step which eliminates the need for proper handling of the exhaust gas.

In the embodiment of FIG. 4, the powder wetting device is positioned in a closed loop which can be connected to a reaction tank. In further embodiments, the powder wetting device can be positioned in a cooling loop to cool the electrolyte solution to a desired temperature. During the galvanic process, the electric current and the electrical resistance of the solution produce heat. The galvanic process is preferably carried out at a specific temperature range so that at least a portion of the electrolyte solution is passed through a heat exchanger to cool the solution. The cooled solution is returned to the working tank in a substantially closed loop.

Figure 5:
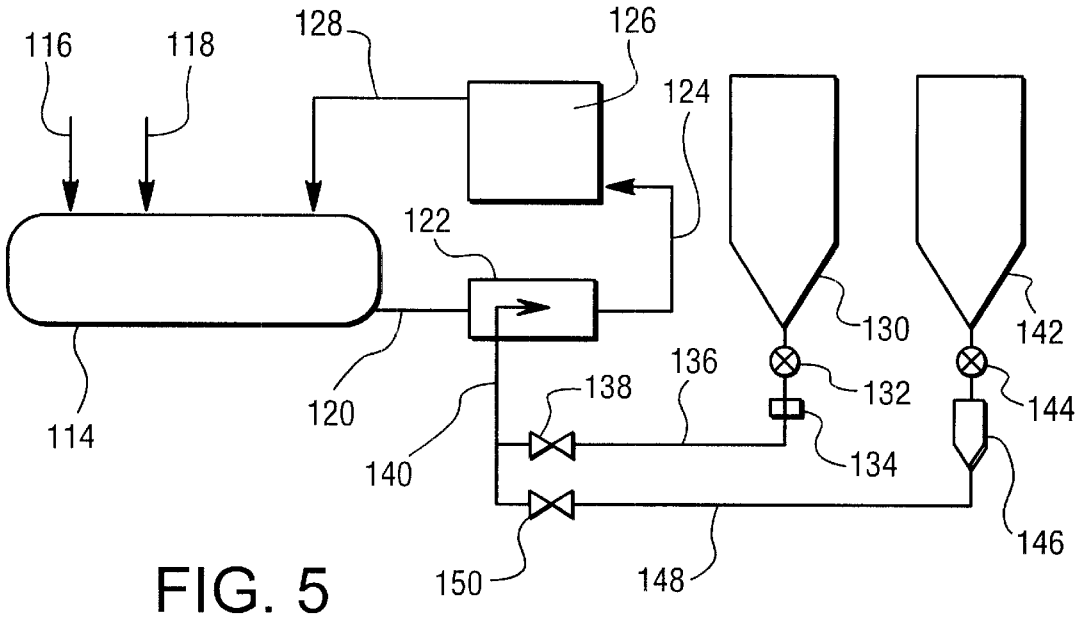
FIG. 5 is a schematic diagram of a zinc-nickel electroplating plant in a further embodiment of the invention.

FIG. 5 illustrates a further embodiment of the invention for preparing a zinc/nickel electrolyte solution suitable for an electrolytic galvanizing process. A working tank 114 having a volume of about 50 cubic meters is filled with about 40 cubic meters of demineralized water from a pipe 116. The water is heated to about 55° C. and concentrated sulfuric acid is metered into the tank 114 through a pipe 118 to produce a sulfuric acid solution of suitable concentration for producing the electrolyte solution. The acid solution is withdrawn through a pipe 120 through a powder wetting device 122 and directed through a pipe 124 to a secondary reaction container 126. The acid solution is then carried through pipe 128 and returned to the tank 114.

The powder wetting device 122 is substantially the same as the device in the embodiment of FIG. 4. Zinc oxide powder is delivered from a supply 130 through a metering device 132 to a weighing device 134. The weighing device 134 measures the necessary amount of zinc oxide to obtain the desired zinc concentration. The powdered zinc oxide is carried through a pipe 136 and through a valve 138 to the low pressure inlet 140 of the powder wetting device 122. The zinc oxide powder is dispersed in the acid solution in the powder wetting device 122 to dissolve the zinc oxide and form the zinc sulfate for the electroplating process. When the desired zinc concentration is obtained, the valve 138 is closed. Zinc carbonate from a supply 142 is fed through a metering device 144 to a weighing device 146 for weighing a predetermined amount of nickel carbonate. The nickel carbonate is then carried through a line 148 and through a valve 150 which directs the powdered nickel carbonate to the inlet 140 of the powder wetting device 122. When nickel carbonate is added to the acid solution, it is generally desirable to include the secondary reaction container 126 since nickel carbonate dissolves at a slower rate than the zinc oxide.

In embodiments of the invention, the zinc oxide is first added to the acid solution, followed by the addition of the nickel carbonate. Preferably, additional sulfuric acid is added to the tank 114 at the completion of the addition of the zinc oxide and prior to the addition of the nickel carbonate. In alternative embodiments, the nickel carbonate can be added to the acid solution, followed by the addition of the zinc oxide. In the embodiment illustrated, a single powder wetting device 122 is provided to disperse the zinc oxide and the nickel carbonate. In further embodiments, separate powder wetting machines can be provided to disperse and dissolve the powdered materials. The process and apparatus of the embodiment of FIG. 5 is able to prepare a zinc/nickel electrolyte solution suitable for electrolytic plating in about 48 hours compared to about 80 hours of the prior processes. The process and apparatus also avoid the formation of hydrogen in the exhaust gas. The zinc and nickel are quickly dispersed in the acid solution to prevent the chemical cementation of the dissolved nickel on the zinc. Since zinc is more basic than the nickel, the nickel in the prior processes often deposit on the zinc.

The zinc and nickel consumption from the electrolyte solution is monitored using standard procedures such as by pH measurements, conductivity measurements, X-ray fluorescence measurements, or photometric measurements of the nickel. The measurements can be made at the inlet of the powder wetting device and/or at the outlet of the powder wetting device. During the electroplating process, the powder wetting device 122 continually recirculates the electrolyte solution to add the nickel carbonate and zinc oxide in amounts corresponding to the amount consumed during the plating process.

The powder wetting device of the embodiments of FIGS. 4 and 5 can be used in combination with the process and apparatus of FIGS. 1–3. For example, zinc oxide can be added to an acid solution using the powder wetting device and the nickel carbonate dissolved in a conventional stirring and mixing device. Alternatively, the zinc can be dissolved in a conventional zinc dissolving column or tank and the nickel carbonate added by the powder mixing device. In addition, the powder wetting device can be used to replenish an electrolyte in an acid pickling bath for pickling steel or stainless steel.

It is to be understood that the foregoing description of the invention discloses several embodiments of the invention and that numerous modifications or additions can be made therein without departing from the scope of the invention as set forth in the appended claims.

What is claimed is:

1. A process of supplying a soluble metal compound to an electrolyte solution comprising:

providing said electrolyte solution and directing said electrolyte solution through a powder wetting device, said powder wetting device having a rotating impeller producing a vacuum in said powder wetting device; and supplying said soluble metal compound to said vacuum and drawing said soluble metal compound into said powder wetting device, thereby dispersing and dissolving soluble metal compound in said electrolyte solution passing through said powder wetting device.

2. The process of claim 1, wherein said electrolyte solution is a sulfuric acid electroplating solution.

3. The process of claim 2, wherein said soluble metal compound is powdered zinc oxide.

4. The process of claim 1, wherein said soluble metal compound is nickel carbonate.

5. The process of claim 1, wherein said soluble metal compound is zinc oxide and said process further comprises sequentially supplying nickel carbonate to said electrolyte solution.

6. The process of claim 1, comprising:

feeding said soluble metal compound from a storage vessel to a weighing device; and weighing a predetermined amount of said soluble metal compound and supplying said predetermined amount to said powder wetting device.

7. The process of claim 6, wherein said electrolyte solution is an electroplating solution for supplying to an electroplating tank, said process further comprising electroplating a metal onto a substrate and calculating said predetermined amount of said soluble metal compound based on an amount consumed by said electroplating in said electroplating tank.

8. The process of claim 6, wherein said storage vessel is a tank or silo.

9. The process of claim 1, comprising continuously supplying said soluble metal compound to said electrolyte solution.

10. The process of claim 1, wherein said soluble metal compound is a galvanic salt.

11. The process of claim 1, wherein said soluble metal compound is supplied intermittently to said powder wetting device, and said electrolyte solution is an electroplating solution supplied to an electroplating tank having an electric current passing therethrough to plate a metal substrate, said process further comprising determining an amount of said soluble metal compound to be added to said electrolyte solution based on said electric current.

12. The process of claim 1, wherein said electrolyte solution is from an electrolytic treating tank and wherein said process further comprises dissolving said soluble metal compound in said electrolyte solution.

13. The process of claim 1, wherein said powder wetting device includes an axial inlet connected to an electrolytic treating tank for receiving said electrolyte solution, and an axial inlet for receiving said soluble metal compound, said process comprising directing said soluble metal compound and electrolyte solution radially outward with respect to said impeller and dispersing and dissolving said soluble metal compound.

14. The process of claim 13, wherein said powder wetting device has a radial outlet, said process further comprising directing said electrolyte solution and dissolved metal compound radially outward through said outlet.

* * * * *